United States Patent [19]

Misik

[11] 4,308,899

[45] Jan. 5, 1982

[54] METHOD AND INSTALLATION OF FILLING BUNKERS BY MEANS OF LIFTING BINS

[75] Inventor: Norbert Misik, Vienna, Austria

[73] Assignee: Waagner-Biro Aktiengesellschaft, Austria

[21] Appl. No.: 100,542

[22] Filed: Dec. 5, 1979

[30] Foreign Application Priority Data

Dec. 20, 1978 [AT] Austria ..... 9090/78

[51] Int. Cl.[3] ..... B65B 3/06; B65B 37/02; B67C 3/34

[52] U.S. Cl. ..... 141/1; 141/232; 141/284; 212/130; 414/199

[58] Field of Search ..... 141/1, 93, 231, 232, 141/233, 284, 392; 212/128, 130, 213; 414/199, 293

[56] References Cited

U.S. PATENT DOCUMENTS 3,255,499 6/1966 Crowell et al. ..... 212/128 X

FOREIGN PATENT DOCUMENTS 30678 4/1926 Norway ..... 141/232

*Primary Examiner*—Frederick R. Schmidt

*Attorney, Agent, or Firm*—Steinberg & Raskin

[57] ABSTRACT

Method and apparatus for filling bins with bulk material and, in particular, for filling a cooling bin with hot coke include engaging the material containing vessel with hoisting apparatus, lifting the hoisting apparatus upwardly in a vertical fixed guide and at the end of the upward movement introducing the hoisting apparatus into a vertical guide assembly, moving the vertical guide assembly and hoisting apparatus in a transverse direction over rails until the hoisting apparatus and the vessel are located vertically over the inlet opening of the bin. The hoisting apparatus and vessel are lowered until the latter is mounted on a stationary support so that upon the vessel discharge opening being opened, the contents of the vessel will be transferred to the bin.

12 Claims, 1 Drawing Figure

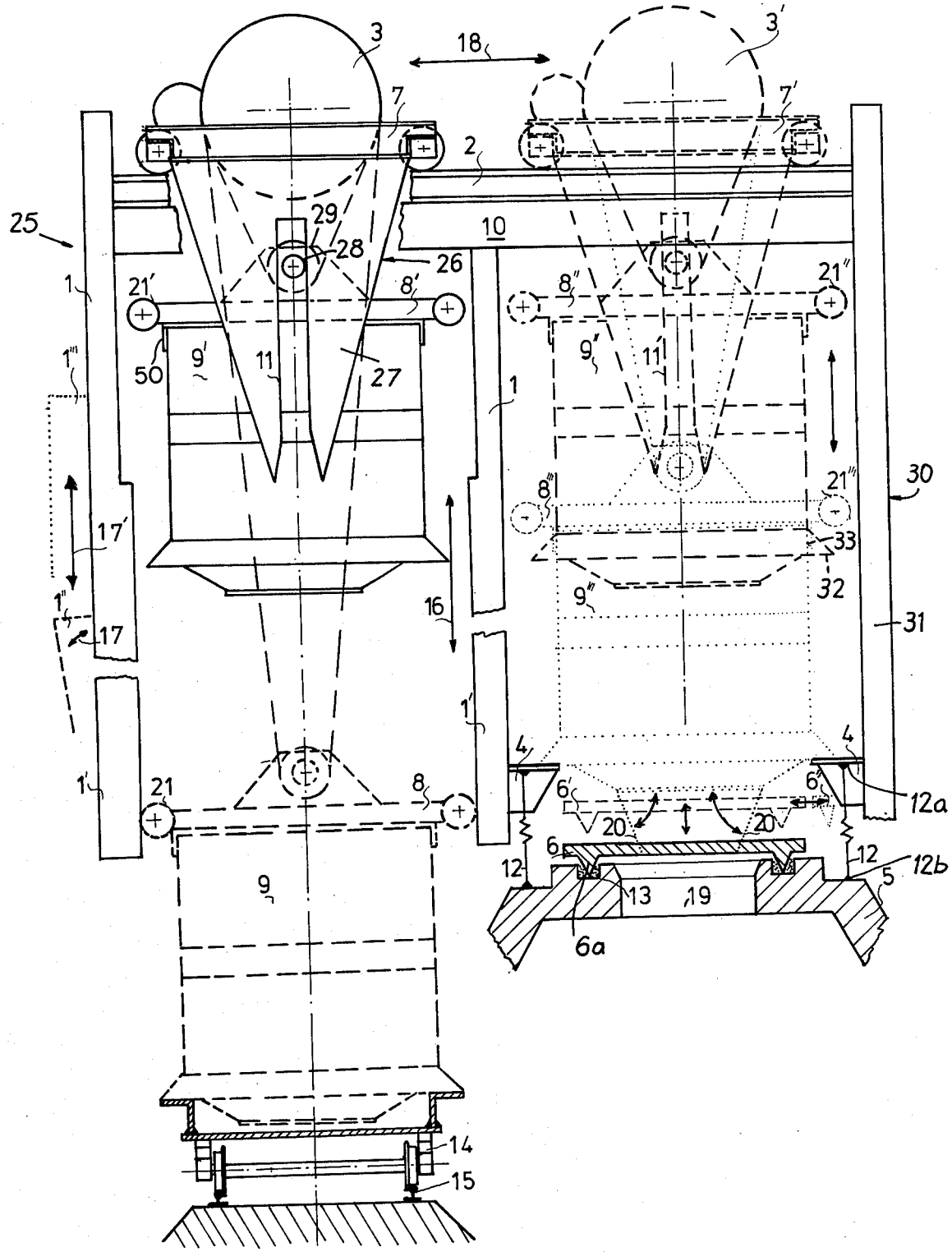
3
18
3'
7
7'
2
25
29
28
26
10
1
21'
8'
8''
21''
1'''
50
9'
11
27
9''
11
1
8'''
21'''
30
17'
33
32
9'''
1''
17
16
31
1'
4
4
1'
21
8
6'
6''
12a
20
20
6
12
12
12b
5
9
13
19
6a
14
15

METHOD AND INSTALLATION OF FILLING BUNKERS BY MEANS OF LIFTING BINS

BACKGROUND OF THE INVENTION

This invention relates generally to methods and apparatus for filling bins with bulk material by means of hoistable vessels and, in particular, to methods and apparatus for filling cooling bins with hot coke.

After ejection from the coking furnace, hot coke is usually transported to and deposited within cooling bins. Since the material inlet openings in such cooling bins are located at the top thereof, it is necessary to lift the hot coke to the height of the opening when the cooling bins are being filled.

Several arrangements for filling cooling bins with hot coke are presently in use. For example, in one arrangement, a coke filled vessel is lifted in guides and tilted whereupon it empties into the bins. In another arrangement, the hot coke vessel is pulled upwardly on an inclined track and upon reaching the highest point is tilted to empty into and fill the cooling bins.

Thus, the known methods and apparatus for filling cooling bins with hot coke all utilize a filling vessel which requires tilting in order to empty its contents into a cooling bin. However, such arrangements are disadvantageous in that relatively large forces are required to tilt the vessel. Further, when the coke containing vessel is tilted while filling the cooling bin, the vessel discharge opening tends to become obstructed by the material inlet opening of the cooling bin thereby often requiring the filling operation to be temporarily terminated as well as presenting constructional difficulties. This problem is even further aggravated when it is desired to avoid the entrance of air into the cooling bin during filling as is the case in dry coke cooling plants.

SUMMARY OF THE INVENTION

Accordingly, one object of the present invention is to overcome the above-mentioned difficulties in conventional arrangements for filling bins with bulk material and, in particular, for filling cooling bins with hot coke.

Another object of the present invention is to provide a new and improved method and apparatus which does not require the application of large forces at the top ends of cooling bins where the inlet openings are located.

Another object of the present invention is to provide a new and improved method and apparatus wherein the discharge and sealing openings of the material containing vessel and bin do not become obstructed during the filling operation.

Still another object of the present invention is to provide a new and improved method and apparatus wherein cooling bins are filled with hot coke so that air cannot enter into the cooling bins during the filling operation.

Briefly, in accordance with the present invention, these and other objects are attained by providing a method and apparatus for filling bins with bulk material and, in particular, for filling cooling bins with hot coke, wherein the vessel containing the hot coke is engaged and lifted by hoisting apparatus which itself is located in a fixed vertical guide and wherein at the end of the vertical travel of the hoisting apparatus, the latter is moved out of the fixed guide and introduced into a vertical guide assembly. The vertical guide assembly is transversely or horizontally displaceable together with the hoisting apparatus and associated coke vessel so that it is located vertically over the inlet aperture of the cooling bin. The hoisting apparatus lowers the vessel over the bin inlet opening whereupon the vessel is supported by stationary supports provided adjacent to the inlet opening. The bin inlet opening which is normally locked is then opened whereupon the discharge opening of the vessel located at the bottom end thereof and which is normally locked is then opened so that the contents of the vessel is emptied into the bin.

According to the present invention, apparatus is provided for filling bins with bulk material according to the method described above and includes a hoisting mechanism which is mounted for horizontal movement on rails, vertically extending fixed or rigid guides over which the hoisting mechanism can be located to lift the material containing vessel and support structure associated with the rails on which the hoisting mechanism is mounted together with the rail support frame, which support structure fluidly seals the vessel discharge and bin inlet openings from the external environment and which also carries a mechanism for locking the bin inlet opening.

In this manner, hot coke can be transferred into cooling bins without the necessity of tilting the coke containing vessel during the filling operation and in a manner which eliminates or at least significantly reduces the possibility of ambient air contacting the bulk material, i.e., coke, thereby greatly decreasing and even eliminating any oxidation of the bulk material which might otherwise occur.

DESCRIPTION OF THE DRAWINGS

A more complete appreciation of the present invention and many of the attendant advantages thereof will be readily appreciated when the same is considered in connection with the following description in conjunction with the accompanying drawing which is a schematic elevation view of one embodiment of the apparatus of the present invention for performing the method thereof.

DETAILED DESCRIPTION OF THE PREFERRED EMBODIMENTS

Referring now to the drawing, the bulk material handling apparatus of the present invention is generally designated 25. As will be more fully described below, a vessel which contains the bulk material is illustrated in four different locations and is designated 9, 9', 9'' and 9''' in the four positions, respectively. Similarly, hoisting apparatus are also illustrated in four corresponding configurations and are respectively designated 8, 8', 8'' and 8'''. Hoisting mechanism 3, trolley 7 and hoisting unit guide 11 are illustrated in first and second laterally displaced positions and are each designated by their respective reference numerals, unprimed and primed in the first and second positions, respectively.

The bulk material is collected in vessel 9 which is moved into operative relation with apparatus 25 by means of a truck 14 running on rails 15. Thus, the material containing vessel is moved to a first position 9 and in this position is located directly vertically beneath hoisting apparatus 8. The hoisting apparatus is lowered onto vessel 9 by a hoisting mechanism 3, described below, whereupon it engages the vessel in the first position and is locked thereto by lock mechanisms schematically illustrated at 50, which are conventional in themselves. The locking mechanisms are preferably designed in a manner such that their actuation can be effected only when the vessel 9 is mounted on truck 14.

Hoisting apparatus 8 comprises a frame assembly which is guided in a vertically extending guiding assembly comprising fixed, vertical guides 1. More particularly, the hoisting apparatus 8 is provided with rollers 21 which engage the fixed guides 1 as seen in the first position illustrated in the figure and will remain in engagement with the guide 1 until reaching an upper portion of the upper travel of apparatus 8 as described below. In this connection, the rollers are designated 21, 21', 21'' and 21''' in their four positions corresponding to the four positions of the vessel and hoisting apparatus described above. In this manner, the attachment of hoisting apparatus 8 on vessel 9 is facilitated as is a vibration-free hoisting movement of the vessel into the second position, designated 9'.

After the hoisting apparatus 8 is engaged to vessel 9, the vessel is hoisted in the upward direction, such movement being represented by arrow 16. In order to reduce the space requirements of the apparatus of the invention and in order to enable the handling of relatively large bulk material thereby, the bottom portions 1' of the fixed guides 1 are preferably designed so as to be displaceable outwardly from the planar contour of the guide assembly. More particularly, the bottom guide portions 1' are preferably designed so as to allow them to be tilted firstly into a position designated 1'' and then pulled upwardly to the position designated 1''' as indicated by arrows 17, 17'. In this connection, the bottom guide portions 1' are preferably rigidly interconnected with each other by a service bridge or the like so that their movement as described above can be accomplished in a joint manner.

At a point during the upward travel of vessel 9, the rollers 21 are disengaged from the fixed guides 1. In the present embodiment, this is accomplished by narrowing the width of the guides.

Substantially simultaneously with the rollers 21 disengaging the fixed guides 1, the hoisting apparatus engages a vertical guide assembly 26. More particularly, in the illustrated embodiment, a pair (only one shown) of guide plates 27 are affixed at their upper ends to trolley 7 and extend downwardly therefrom. Each of the plates 27 has a vertical guide slot 11 in which the respective ends of a shaft 28 are received during the terminal portion of the upward movement of the hoisting apparatus to position 8'. The shaft 28 mounts pulleys 29 which form part of the hoisting apparatus 8.

Thus, at substantially the same time as the rollers 21 disengage the fixed guides 1, the hoisting apparatus 8 is received and guided within a vertical guide unit or vertical guide assembly 26 associated with the movable trolley 7.

The hoisting mechanism 3 which serves to lift the hoisting apparatus 8 is mounted on the crane trolley 7 which itself is mounted on wheels for movement in a transverse or horizontal direction over rails 2. Hoisting mechanism 3 preferably has a double symmetrical rope arrangement which is trained about an upper large diameter pulley and the lower pulley 29 of the hoisting apparatus 8. In this manner, should one of the ropes of the hoisting mechanism 3 rupture during use, the vessel 9 will still remain suspended from the other rope. Further, an 8-fold reeving is preferably utilized so that the vessel 9 will not swing outwardly in the case of rope breakage. When a dual rope arrangement is utilized, one of them is associated with the outer rope pulleys of the conventional blocks while the other rope is associated with the inner rope pulleys. This is an advantageous construction in that damage, particularly to the guides, resulting from rope breakage can be avoided by allowing the vessel to swing outwardly. In this manner, the present invention increases the safety of plant operation.

Upon the hoisting apparatus engaging the slots 11 of the vertical guide assembly 26 and moving to its uppermost position therein as illustrated by vessel 9' in the figure, the trolley 7 together with the hoisting mechanism 3 mounted thereon and material containing vessel 9' carried by the hoisting apparatus 8, are horizontally or transversely moved to the right in the figure as represented by arrow 18 to the third position designated by vessel 9''. In this position, the vessel 9'' is located directly vertically above the inlet opening 19 of bin 5. Thus, the trolley 7 moves to the position designated 7' wherein the housing mechanism 3', hoisting apparatus 8'' and material containing vessel 9'' are located over inlet opening 19.

It is noted that there is a double connection of the hoisting apparatus 8'' with the trolley 7. More particularly, the hoisting apparatus 8 is connected to the trolley 7' by means of the ropes of the hoisting mechanism 3 on the one hand and, on the other hand the hoisting apparatus 8'' is received within the guide slots 11 of the guide assembly 26. In this manner, the swaying or swinging of the vessel 9'' is reduced or completely eliminated.

With trolley 7' in its second position, the vessel 9'' is located directly vertically above the inlet opening 19 of cooling bin 5. The hoisting mechanism 3' is activated so that the vessel 9'' is lowered with hoisting apparatus 8'' until it occupies the fourth position, designated 9'''. In this connection, a fixed frame structure 10 includes the fixed guides 1 and a column structure 31. The lower ends of one of the fixed guides 1 and the column structure 31 are located immediately adjacent to the inlet opening 19 of the cooling bin 5 as shown in the drawing. A ring-shaped stationary support 4 is affixed, such as by welding, to the fixed guide 1 and column structure 31 and is concentric with respect to the inlet opening 19. Upon the vessel descending to the fourth position designated 9''', a downwardly facing shoulder 32 defined by a lower skirt 33 integral with vessel 9 engages the stationary support 4 in a manner such that the lower funnel-shaped end of vessel 9 extends vertically beneath the plane of the stationary support 4.

As seen in the FIGURE, during the entire descent of the vessel from position 9'' to position 9''', the member 28 of hoisting apparatus 8 is guided within guide slot 11' so that vessel 9 is positively guided during its descent until supported by stationary support 4.

A cylindrical elastic sleeve 12 has its upper edge sealingly affixed to stationary support 4 as indicated at 12*a* and its lower edge sealingly affixed to the bin 5 around the inlet opening 19 as indicated at 12*b*. Thus, when vessel 9''' rests on support 4, a closed space is defined by the elastic sleeve 12, the bin locking mechanism 6 and lower end of vessel 9'''. In this manner, when vessel 9 is located in the fourth position designated 9''', ambient air cannot enter the closed space defined thereby and, similarly, dust and other pollutants cannot escape from either the bin or the vessel.

With the vessel located in its fourth position as described above, the bin locking mechanism 6 is lifted to the dotted-line position 6' by conventional opening means (not shown) so that the annularly extending sealing edge 6a thereof is withdrawn from the sealing material 13, which can comprise a sand or water seal. The locking mechanism is then moved laterally into the position designated 6''.

In this manner, the inlet opening 19 of bin 5 is opened. At this time, flaps 20 which normally close the discharge opening of vessel 9''' are opened whereupon the bulk material empties from vessel 9''' and fills bin 5. As described above, by virtue of the particular sealing apparatus including the stationary support 4 and cylindrical elastic sleeve 12, no dust or other pollutants can escape into the atmosphere so that the bulk material which is transferred into the bin will not pollute the environment. Similarly, emissions into the atmosphere from the vessel and bin are prevented. Further, by suitably controlling the pressure of the cooling gas introduced into the bin, it is possible to prevent emissions of dust and the like into the atmosphere when the vessel 9''' is lifted from support 4.

In the illustrated embodiment, the stationary support 4 takes the form of a ring-shaped plate member supported by a bracket affixed to the surfaces of guide 1 and column structure 31. In this embodiment, the cylindrical elastic sleeve 12 is sealingly affixed to the lower surface of the support 4. However, it is understood that other configurations of the support 4 are possible within the scope of the present invention. For example, the support may take the form of a double bracket, i.e., a bracket having a pair of vertically opposed ring-shaped plates. In this case, the upper plate is adapted to support the downwardly facing shoulder 32 of vessel 9 while the bottom plate functions as a water seal. The lower plate can be provided with a plunger cylinder which, when actuated, will close the opening created by the removal of vessel 9 after the filling operation. In this case, the elastic sleeve 12 is joined at its upper end to the water seal provided at the lower plate of the double bracket. In operation, after the vessel 9''' is mounted on the upper plate of the supporting bracket and the bin locking mechanism 6 is opened, an inflow funnel is formed by the bottom flaps 20 for the bin inlet opening 19.

It is essential that the various guides and other apparatus comprising the present invention be rigidly connected with the frame 10 with which the bin 5 is associated. The provision of the elastic sleeve 12 to interconnect the bin inlet opening 19 with the support 4 avoids any detrimental effects which might result from differentials in expansion caused by heating.

As described above, the vertical guide assembly 26 functions to guide the hoisting apparatus 8 while the latter is in the positions designated 8', 8'' and 8'''. However, if the guide assembly 26 is modified so that the vertical guide slots 11 are elongated, the vessel 9 can also be guided thereby between the positions designated 9', 9'' and 9'''. In this manner, connecting forces present at the point of connection of the hoisting apparatus 8 and vessel 9 can be relieved. In such embodiments, the portion of fixed guides which are engaged by the rollers 21 are elongated so as to extend to the position designated 8'.

The present invention provides a method and apparatus which finds general use in filling bins with bulk material. However, the invention is particularly suited for application to the transfer of hot coke which has been moved into a vessel after its ejection from the coking furnace into a cooling bin. However, it is understood that the method and apparatus of the invention can also be used in connection with charging metallurgical furnaces, such as lime kilns or coking chambers. In the latter application, preheated coal can be introduced into the coking oven with the entry of ambient air substantially excluded.

Obviously, numerous modifications and variations of the present invention are possible in the light of the above teachings. Accordingly, it is understood that within the scope of the appended claims the invention may be practiced otherwise than as specifically disclosed herein.

What is claimed is:

1. A method for filling bins with bulk material contained within a vessel and, in particular, for filling cooling bins with hot coke, comprising the steps of:

locking the material containing vessel to hoisting apparatus;

hoisting the hoisting apparatus and vessel locked thereto in a vertically extending fixed guide so that the vessel is accurately guided during the hoisting thereof;

at the substantial end of the movement of the hoisting apparatus within the fixed guide, introducing the hoisting apparatus into a movable guide assembly;

moving the guide assembly with hoisting apparatus and vessel associated therewith in a transverse direction until it is located substantially vertically over the inlet opening of the bin and so that the vessel is accurately guided during the transverse movement thereof;

with the guide assembly stationary, lowering the hoisting apparatus and vessel until the latter is mounted on stationary support directly above the bin inlet opening, said lowering being conducted with the hoisting apparatus maintained within the movable guide assembly so that the vessel is accurately guided during the lowering thereof;

unlocking the bin inlet opening; and opening the vessel discharge opening whereby the contents of the vessel fill the bin.

2. Apparatus for filling bins with bulk material contained within a vessel and, in particular, for filling cooling bins with hot coke, comprising:

a frame structure including fixed guides vertically extending over an initial location at which a vessel containing hot bulk material is adapted to be positioned, said fixed guides terminating at an upper end region;

hoisting apparatus having means for engaging said fixed guides so as to be vertically guidable in engagement with said fixed guides both upwardly and downwardly within said fixed guides, said hoisting apparatus including means for locking the same to the vessel so that when said hoisting apparatus is vertically guided within said fixed guides with the vessel locked thereto, the latter is guided in its vertical movement;

hoisting means for hoisting and lowering said hoisting apparatus, said hoisting means being mounted on substantially horizontally extending rails for horizontal movement between a first position located vertically above said fixed guides and a second position located vertically above a location at which a bin to be filled with bulk material is adapted to be positioned;

a guide assembly fixed to said hoisting means so as to be moveable therewith between said first and second positions, said hoisting apparatus including a guide member and said guide assembly including downwardly extending guide means extending at least to the upper end region of said fixed guides and being aligned with said guide member when said hoisting means is in said first position for receiving said guide member when said hoisting apparatus is at the upper end region of said fixed guides, whereby upon said hoisting apparatus being hoisted above said fixed guides so as to be disengaged therefrom, said guide member is received in said guide means of said guide assembly;

a stationary vessel support fixed to said frame structure, said vessel support being situated vertically below said second position of said hoisting means a distance such that when said hoisting means is in said second position and the vessel locked to said hoisting apparatus lowered, said guide member is maintained in its received relationship within said guide means of said guide assembly at least until the vessel is supported by said stationary vessel support; and means for interconnecting said stationary support and bin in a fluid sealed manner;

whereby said vessel is positively guided by said fixed guide as it is raised from the initial position by said guide means as said hoisting means moves from said first to said second position, and by said guide means as it is lowered until it is supported by said stationary support.

3. Apparatus as recited in claim 2 wherein said fixed guides and rails and stationary vessel support are rigidly affixed to said frame structure.

4. Apparatus as recited in claim 2 wherein said hoisting means comprises a crane trolley and said hoisting apparatus engaging means includes rollers adapted to engage said fixed guides at least during a major portion of the vertical travel of said hoisting apparatus within said fixed guides.

5. Apparatus as recited in claim 2 wherein said guide assembly guide means comprises at least one member having a vertical guide slot formed therein.

6. Apparatus as recited in claim 5 wherein said hoisting apparatus includes a locking mechanism which can be actuated only when the hoisting apparatus is attached to said vessel.

7. Apparatus as recited in claim 5 wherein said hoisting means comprises a crane trolley and said at least one member having said guide slot formed therein is affixed to said trolley.

8. Apparatus as recited in claim 7 wherein said hoisting apparatus includes at least one rope pulley and wherein said hoisting means further includes at least one hoisting pulley mounted on said trolley provided with two symmetrical hoist windings for hoisting a dual arrangement of ropes having one end connected to said hoisting means and the other end to said crane trolley, said ropes being trained over said hoisting apparatus and trolley mounted pulleys.

9. Apparatus as recited in claim 2 wherein lower portions of said fixed guides comprise guide bars which are retractably mounted, and means for interconnecting said retractable guide bars so that both are retractable as a unit outside the contour of said fixed guides.

10. Apparatus as recited in claim 2 wherein said means for interconnecting said stationary support and bin in a fluid sealed manner comprises an elastic sleeve having an upper edge sealingly connected to said vessel support and a lower edge sealing connected to said bin.

11. Apparatus as recited in claim 2 wherein said stationary support comprises an annularly extending shoulder so that when said vessel is supported thereby, the space defined by the vessel, bin and said interconnecting means is substantially sealed from the external atmosphere.

12. Apparatus for filling a bin with bulk material contained within a vessel comprising:

frame structure including a pair of fixed guides extending upwardly from a first location at which a bulk material containing vessel is adapted to be located; at least one upstanding member extending upwardly from a second location at which a bin is adapted to be located; and rails extending transversely between a first position overlying said first location and a second position overlying said second location;

a hoisting assembly including a crane trolley mounted on said rails for movement between said first and second positions, a pulley assembly carried by said trolley, and a guide assembly including a slot defining plate, said slot extending vertically downwardly and opening at its lower end at a region at or below the upper end region of said fixed guides;

hoisting apparatus connected to said pulley assembly including means for locking the same to a bulk material containing vessel, said hoisting apparatus including means for engaging said fixed guides and a guide member adapted to be received in said slot of said guide assembly; and a vessel support fixed to said frame structure adapted to support the vessel over said second location, said support being vertically spaced from the open end of said slot by a distance such that said guide member will be maintained within the slot as the vessel is lowered by said hoisting apparatus in its second position at least until the vessel is supported on said support, whereby the vessel is continuously positively guided from its first location until it is supported on said support by either said fixed guides or said guide assembly.

* * * * *